US005175391A

United States Patent [19]

Walters et al.

[11] Patent Number: 5,175,391

[45] Date of Patent: Dec. 29, 1992

[54] METHOD FOR THE MULTIMATERIAL CONSTRUCTION OF SHAPED-CHARGE LINERS

[75] Inventors: William P. Walters, Elkton; Stanley K. Golaski, Aberdeen, both of Md.; Pei C. Chou, Wynnewood, Pa.

[73] Assignee: The United States of America as represented by the Secretary of the Army, Washington, D.C.

[21] Appl. No.: 349,378

[22] Filed: Apr. 6, 1989

[51] Int. Cl.[5] ..... F42B 1/02

[52] U.S. Cl. ..... 102/307; 102/309; 102/476

[58] Field of Search ..... 102/307, 476, 309

[56] References Cited

U.S. PATENT DOCUMENTS

| | | | |
|---|---|---|---|
| 4,327,642 | 5/1982 | Gross-Benne et al. | 102/307 |
| 4,498,367 | 2/1985 | Skolnick et al. | 102/307 X |
| 4,499,830 | 2/1985 | Majerus et al. | 102/476 |
| 4,537,132 | 8/1985 | Sabranski et al. | 102/307 |
| 4,649,828 | 3/1987 | Henderson et al. | 102/476 |
| 4,672,896 | 6/1987 | Precoul et al. | 102/476 X |
| 4,747,350 | 5/1988 | Szecket | 102/306 |
| 4,766,813 | 8/1988 | Winter et al. | 102/307 |

OTHER PUBLICATIONS

Chou et al., *Jet Formation Mechanics of Hemispherical Liner Warheads*, 1983 pp. 24–29.

*Primary Examiner*—Peter A. Nelson

*Attorney, Agent, or Firm*—Saul Elbaum; Paul Clohan; Walter R. Baylor

[57] ABSTRACT

A shaped charge device having a cylindrical housing, an explosive charge with a cavity at one end, a fuze, booster, a multimaterial vertically layered liner having a hemispherical, semi-hemispherical, arcuate or conical shape with a number of segments of materials, each segment in contact with the explosive charge and the cavity, each segment oriented normal, parallel or oblique to the charge axis. The detonating of the explosive charge causes the liner to form a jet of a plurality of the segments. A method of manufacture is also disclosed wherein the liners made in the vertical manner avoid mixing or interaction between dissimilar materials undergoing the jetting action. Vertically layered liners provide excellent material flow and liner collapse diagnostics.

5 Claims, 3 Drawing Sheets

METHOD FOR THE MULTIMATERIAL CONSTRUCTION OF SHAPED-CHARGE LINERS

RIGHTS OF THE GOVERNMENT

The invention described herein may be manufactured, used and licensed by or for the U.S. Government for Governmental purposes without payment to us of any royalty thereon.

BACKGROUND OF THE INVENTION

1. Field of the Invention

The present invention relates in general to explosive devices and, in particular, to a new and useful design for multimaterial liners for shaped charge devices. A method of manufacture is also disclosed.

2. Description of the Prior Art

It is known to utilize specially shaped charge liners in explosive devices which, upon detonation of the explosive device, break up into individual particulate projectiles. A majority of the shaped charge liner designs in current use are liners fabricated from a single liner material. Notable exceptions are U.S. Pat. No. 4,766,813 which is a shaped charge liner with an isotropic coating; U.S. Pat. No. 4,747,350 which described a liner having two metal layers which have been metallurigically bonded by explosion welding; U.S. Pat. No. 4,499,830 showing a liner with the addition of a lethal material in an annular grove on the exterior wall; U.S. Pat. No. 4,498,367 which describes a method of selecting materials for multi-layer liners and application Ser. No. 153,817 filed May 19, 1980 showing two liners contiguously joined so as to form two metallic jets. All of these liners consist of two liners of different materials but of similar geometry and joined together such that the inner surface of one liner is in direct contact with the outer surface of the liner of the second material. This concept could, of course, be extended to include more than two layers and more than two materials. Typically, these metal liners are mated together by a simple press fit and bonded with an adhesive or by first explosively bonding the two materials together as plate stock and then cold forming the final liner.

Multimaterial liners having segments of material radially distributed along the liner present distinct advantages over the prior art U.S. Pat. No. 4,499,830 discusses the advantages of the judicious location of certain metallic or non-metallic segments within the parent liner. The present invention describes a method of distributing segments of material throughout the liner in a radial manner. Liners of this type will prove to be extremely valuable as a research tool to determine the distribution and flow of material in a collapsing and stretching liner. Knowledge of the distribution of material in the liner would enable the performance and/or lethality of the shaped charge jet to be enhanced by the judicious placement of key metallic or non-metallic segments throughout the liner.

It therefore may be appreciated that there is a great need for a method to fabricate shaped charge liners having segments of material radially disposed throughout the liner.

OBJECTS AND SUMMARY OF THE INVENTION

It is therefore a primary object of the invention to provide a shaped charge liner composed of two or more segments of material radially distributed throughout the liner.

Another object of this invention is to facilitate the determination of the distribution and flow of material in a collapsing and stretching liner.

A further object of this invention is to enhance the performance and lethality of shaped charge jets by the judicious placement of key metallic or non-metallic segments throughout the liner.

An additional object of this invention is to provide gaps or a space along the jet resulting in a dual shaped charge jet.

A still further object of this invention is the placement of different materials at key locations within the jet to provide pyroforic effects, enhance lethality, increase target penetration, increase the target hole volume and reduce the amount of expensive, heavy or rare materials required in the liner.

It is also the object of this invention to provide a method for fabricating the disclosed multimaterial shaped charge liners.

In accordance with the present invention, a series of plates or concentric cylinders of different materials are first bonded together to form a stack of materials. Depending upon the desired material orientation in the subsequent liner, excess material is removed from the stack, resulting in a liner in the shape of a hemisphere, semi-hemisphere, arcuate surface or conical surface. The segments of material can be oriented normal, parallel or oblique to the vertical axis of the shaped charge housing. Fuzing, boostering and detonation of the explosive is as in conventional shaped charge devices.

DETAILED DESCRIPTION OF THE PREFERRED EMBODIMENTS

Figure 1:
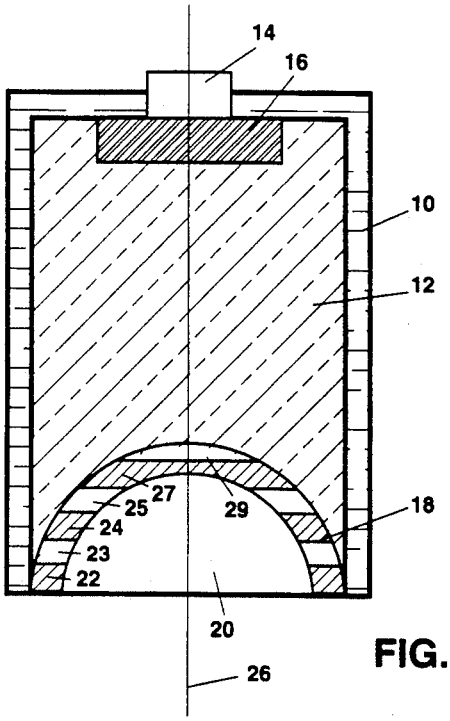
FIG. 1 is cross sectional view of one embodiment of the present invention

Referring now to FIG. 1, there is illustrated a shaped charge device with a multimaterial liner according to the present invention. A cylindrical housing 10 with a closed end 11 and an open end 13 is provided to contain the shaped explosive charge 12. A conventional fuze 14 and booster 16 located at the closed end 11 is used to detonate the shaped explosive charge 12. A multimaterial liner 18 is used to line the cavity 20 of the shaped explosive charge 12. Multimaterial liner 18 is hemispherical in shape and consists of six segments; three segments of material "A" and three segments of material "B". First segment 22 is made of material "A"; second segment 23 is made of material "B"; third segment 24 is made of material "A"; fourth segment 25 is made of material "B"; fifth segment 27 is made of material "A" and sixth segment 29 is made of material "B". Materials "A" and "B" used in a multimaterial liner application are all materials known to form shaped charge jets including aluminum, copper, steel, iron, zinc, lead, tin, nickel, silver, gold, platinum, titanium, uranium, tantalum, niobium, molybdenum, cadmium, antimony, tungsten and alloys using these materials. Non-metals used as material "A" or "B" include glass, ceramics, graphite, diamond and sitals. Amorphous glassy metals also may be used. As can be seen from FIG. 1, the boundary between segment 22 and segment 23 forms a flat surface which is not in contact with either explosive charge 12 or cavity 20. If a line 25 was drawn parallel to this flat surface, it would intersect vertical axis 26 at a 90 degree angle. The same would be true for the boundary between the remaining segments. Thus it can be said that each segment is oriented perpendicular to vertical axis 26. Liner 18 is hemispherical and thus symmetrical about axis 26. In this instance, material "A" and material "B" alternate in liner 18, that is, there are three layers of material "A" (segments 22, 24 and 27) and three layers of material "B" (segments 23, 25 and 29). Another unique feature of liner 18 is that each segment has a surface facing the explosive charge 12 and a surface facing cavity 20. This is not the case with other multimaterial liners.

Figure 2A:
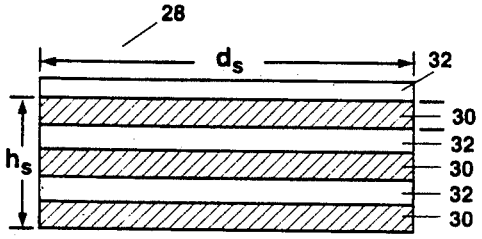
FIG. 2*a* is a front view of the layered stock material used for construction of a multimaterial liner.

FIG. 2*a* shows the construction of the layered stock material 28 from which liner 18 will be fabricated. The layered stock material 28 is made by stacking plates 30 of material "A" and plates 32 of material "B", creating three layers of each. The layered stock material diameter $d_s$ is dependant upon the geometry and maximum dimension of the liner to be fabricated from the layered stock material 28. Rectangular or square plates could also be used. The liner diameter depends on the application for which the shaped charge is intended and may range from a ⅛" diameter (for a small hole tapper charge or research round) up to a 48" diameter (for a large torpedo system). The height of the layered stock material $h_s$ will range from 0.0125 inches up to 2200 inches. The thickness t of each plate depends on the liner to be formed from the layered stock material 28. Typical plate thickness t ranges from $1\times10^{-4}$ inches up to 2000 inches. The plates do not have to be of the same dimensions or thickness nor do alternate plates have to be of different material. Several plates of the same material may be joined together or several plates of the same material with one or more plates of an alternate material positioned anywhere within the stack may be joined together. In fact, several plates of several different materials may be joined together. The plates are bonded together by any of several techniques including explosive welding, diffusion bonding, conventional welding, brazing, soldering, plasma or ion spray deposition, chemical vapor deposition, electroplating, roll bonding or the use of adhesives. These various techniques are within the current state-of-the art and the exact technique for bonding the plates depends on the plate material, size and thickness. However, diffusion bonding has been found to be the overall best technique.

Figure 2B:
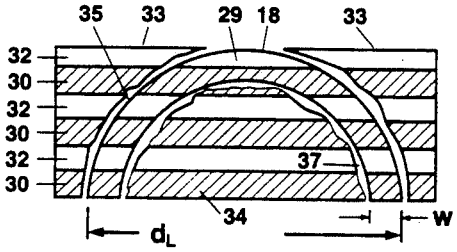
FIG. 2*b* shows the removal of layered stock material to form a multimaterial liner.
Figure 3A:
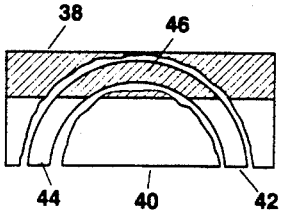
FIG. 3*a* shows an alternate method of liner fabrication.
Figure 3B:
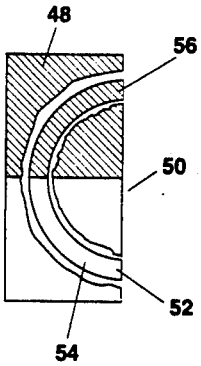
FIG. 3*b* shows an alternate method of liner fabrication.
Figure 4A:
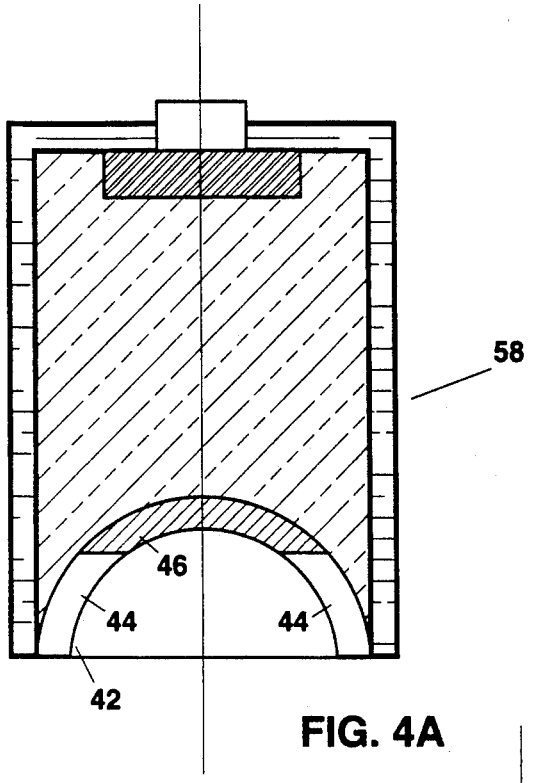
FIG. 4*a* shows an alternate embodiment according to the present invention.
Figure 4B:
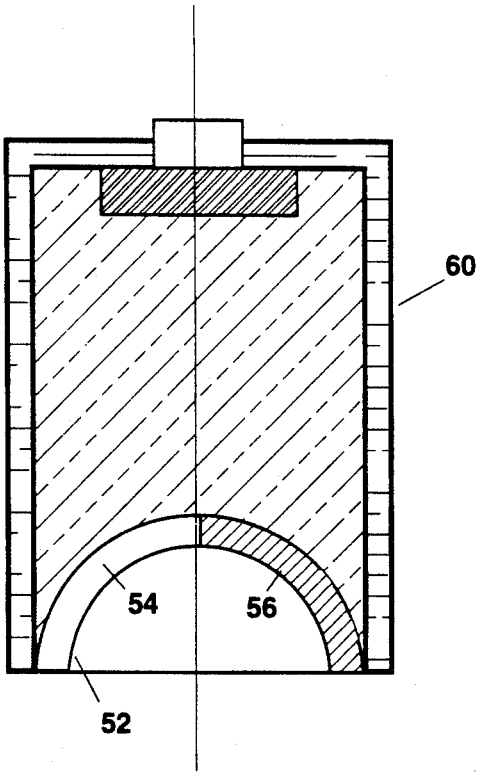
FIG. 4*b* shows an alternate embodiment according to the present invention.

Once the plates have been bonded together as shown in FIG. 2*a*, liner 18 is fabricated from the layered stock material 28, as shown in FIG. 2*b*. Excess layered stock material 33 is removed to form the exterior surface 35 of liner 18. Likewise, excess layered stock material 34 is removed to form the interior surface 37 of liner 18. The diameter $d_L$ of liner 18 and the number of segments within liner 18 depends upon the final liner desired. Shown is a liner 18 with a pole region 29 of material "B". The composition of any given segment of liner 18 can be controlled by the material layer and the geometry of the cut into the layer. The material could be removed as shown in FIG. 3*a*, where removing excess material 38 and excess material 40 results in liner 42 with a lower segment 44 of material "B" and a polar region 46 of material "A". FIG. 4*a* shows an alternate embodiment 58 of the present invention with the use of liner 42 fabricated by this method. FIG. 3*b* shows another alternate method for the removal of excess material from the layered stock material. Excess material 48 and excess material 50 is removed to form liner 52 in which segment 56 of material "A" is on the right half of liner 52 and segment 54 of material "B" is on the left half of liner 52. FIG. 4*b* shows a second alternate embodiment 60 of the present invention using liner 52. In liner 52 a line 55 drawn perpendicular to the boundary surface would now intersect the vertical axis 26 at 90 degrees.

Figure 2C:
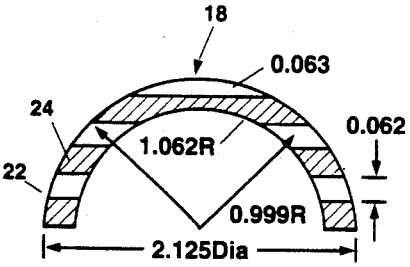
FIG. 2*c* shows the dimensions of a multimaterial liner.

Since most materials exhibit vastly different mechanical, metallurgical and thermodynamic characteristics, one might expect that the shaped charge liner 18 shown in FIG. 1 would fail to provide a coherent jet because the dissimilar materials would lose their bond under the intense dynamic conditions provided by the detonation of high explosive 12; i.e. liner elements would disassociate from each other resulting in an incoherent flow of metallic particles. This, however, is not the case. A multimaterial liner 18 was fabricated by the method shown in FIGS. 2*a* and 2*b*. Nickel was chosen for material "A" and copper was chosen for material "B". Thus segments 22,24 and 27 were made from Nickel and segments 23, 25 and 29 were made from copper. Liner 18 was fabricated to the dimensions shown in FIG. 2*c*. The surfaces of plates 30 and 32 were carefully machined and polished to provide a good smooth fit with each other. The plates were then held together by a fixture which exerted a uniform stress of 1500 psi on the resulting layered stock material 28. This assembly was then placed in a controlled atmosphere furnace at 982° C. for 3 hours to allow a diffusion bond of the Ni—Cu plates. A minimum stress of 1300 psi at the Cu-Ni interface is needed to eliminate or at least minimize the formation of voids at the interface. A test sample bonded this way showed virtually no voids at the interface indicating that 1300 psi is sufficient force to apply the required interface stress. A second liner 18 was also fabricated by applying a higher load to the layered stock material to bond the surfaces. In this technique, the Cu flowed at the entire interface. The temperature and time cycles were the same as above. Both of these techniques provided good quality bonds, but the second method was faster and more economical since a fine surface finish was not a critical requirement. From the layered stock material 28, liner 18 was machined to the dimensions shown in FIG. 2*c*. A device of the type shown in FIG. 1 was then constructed and tested. Flash radiography and particle recovery tests were conducted. The liner remained coherent with each segment of material distributed continuously from the front to the back of the jet. These results were also in agreement with previous analytical studies.

Figure 4C:
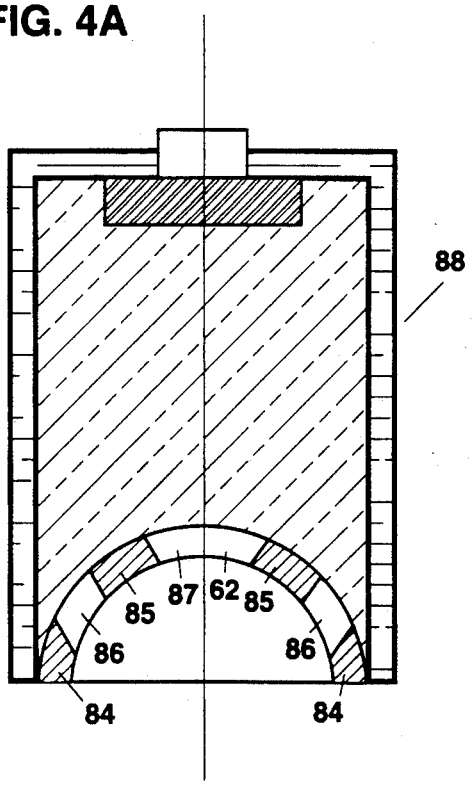
FIG. 4*c* shows an alternate embodiment according to the present invention.
Figure 5:
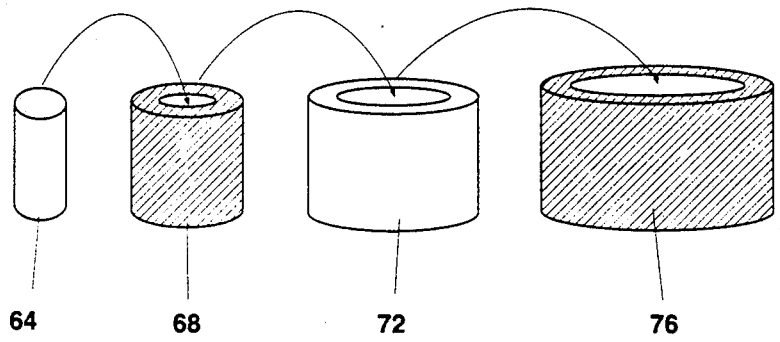
FIG. 5 shows an alternate method of fabrication of layered stock material.
Figure 6A:
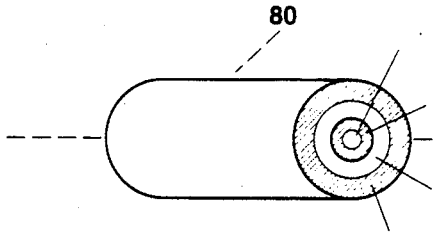
FIG. 6*a* shows an alternate layered stock material.
Figure 6B:
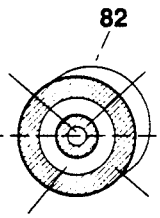
FIG. 6*b* shows a disk made from the alternate layered stock material.
Figure 6C:
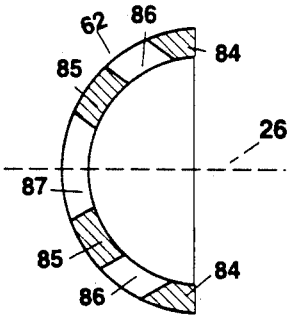
FIG. 6*c* shows a liner made from the alternate layered stock material.

FIG. 5 illustrates an alternate technique for forming a liner where the boundary between each segment of material forms a flat surface of a different orientation to vertical axis 26. Liner 62 shown in FIG. 6*c* is formed by first constructing an assembly of concentric cylinders as shown in FIG. 5. The innermost element is a solid cylinder 64 of material "B" which is inserted into a hollow cylinder 68 made from material "A". This assembly is then inserted into a second hollow cylinder 72 made from material "B". The resulting assembly is now inserted into hollow cylinder 76 made from material "A". The resulting layered stock material 80 is shown in FIG. 6*a*. A disk 82 (FIG. 6*b*) of the final liner thickness is sliced from layered stock material 80 and formed into a hemispherical liner 62 shown in FIG. 6*c*. In this way segments 84 and 85 of material "A" and segments 86 and 87 of material "B" are oriented at an oblique angle to vertical axis 26. FIG. 4*c* shows a third alternate embodiment 88 of the present invention using liner 62. In liner 62 a line 89 drawn parallel to the boundary surface between segments 85 and 86 would now cross vertical axis 26 at an oblique angle.

In the research application of this invention, a multitude of materials could be used. Since most materials have vastly different properties such as bulk speed of sound, melting temperature, ductility, strength, etc., certain combinations of materials may lead to unconventional jet formations, unusual jet particulation patterns, etc. These unconventional modes of formation may lead to interesting jet properties which can be advantageously exploited.

The various liners described above were essentially hemispherical in shape. By varying the amount of excess stock material removed, liners could also be fabricated that were semi-hemispherical, arcuate or conical in shape.

To those skilled in the art, many modifications and variations of the present invention are possible in light of the above teachings. It is therefore to be understood that the present invention can be practiced otherwise than as specifically described herein and still will be within the spirit and scope of the appended claims.

I claim:

1. A shaped charge device having vertical layering comprising:

a cylindrical housing having a closed end, an open end and a vertical axis;

an explosive charge contained within said housing, said charge having a cavity formed at the open end of said housing, said cavity symmetric about said vertical axis;

a vertically layered liner lining said cavity and contacting said charge;

said liner comprising a plurality of segments;

said plurality of segments each having a first, second and third surface, said first surface contacting said charge, said second surface and opposed to said first surface and facing said cavity, and said third surface only contacting an adjacent segment, said third surface being flat in any cross section taken parallel with said vertical axis;

wherein a plane passing through said liner and parallel to said liner's axis of symmetry intersects only one of said liner segments;

means located at the closed end of said housing for detonating said explosive charge whereby detonation of said explosive charge causes said liner to form a jet comprised of a plurality of said segments.

2. The device of claim 1 wherein a line parallel with said third surface will intersect said vertical axis at 90 degrees.

3. The device of claim 1 wherein a line perpendicular with said third surface will intersect said vertical axis at 90 degrees.

4. The device of claim 1 wherein a line parallel with said third surface will intersect said vertical axis at an oblique angle.

5. A process for fabricating a multimaterial shaped explosive charge liner in a vertically layered manner, said process comprising:

forming a plurality of plates of dissimilar materials, each plate having a desired shape with a vertical axis;

stacking the plurality of said plates on top of each other;

bonding said plates together to form a layered stock material;

removing excess material to obtain a liner having segments of material;

forming said liner wherein a plane passing through said liner and parallel to said liner's axis-of-symmetry intersects only one liner material; and whereby a detonation of the explosive charge causes said liner to form a jet action comprised of a plurality of said segments and avoiding an interaction between the dissimilar materials undergoing said jet action.

* * * * *